US005624289A

United States Patent [19]

Kourimsky et al.

[11] Patent Number: 5,624,289

[45] Date of Patent: Apr. 29, 1997

[54] HIGH CURRENT RECEPTACLE TERMINAL

[75] Inventors: Friedrich J. A. Kourimsky, Bensheim; Johann Kilzer, Egelsbach, both of Germany

[73] Assignee: The Whitaker Corporation, Wilmington, Del.

[21] Appl. No.: 432,300

[22] Filed: May 1, 1995

[30] Foreign Application Priority Data

Jun. 6, 1994 [GB] United Kingdom ..... 9411287

[51] Int. Cl.[6] ..... H01R 11/22

[52] U.S. Cl. ..... 439/852

[58] Field of Search ..... 439/852, 839, 439/862

[56] References Cited

U.S. PATENT DOCUMENTS 5,112,254 5/1992 Endo ..... 439/852
5,281,175 1/1994 Chupak et al. ..... 439/839
5,443,592 8/1995 Ittah et al. ..... 439/839

FOREIGN PATENT DOCUMENTS 0147076 7/1985 European Pat. Off. .
0171193 2/1986 European Pat. Off. .
0310487 4/1989 European Pat. Off. .

*Primary Examiner*—Neil Abrams
*Assistant Examiner*—Eugene G. Byrd
*Attorney, Agent, or Firm*—Driscoll A. Nina

[57] ABSTRACT

A receptacle terminal comprises a conductor connection section and a contact section for receiving a male tab terminal therein. Reversely bent pairs of contact arms extending from forward and rearward ends of a cover wall are provided. Free ends of the contact arms rest upon a ledge struck from side walls of the contact section for prestressing the contact beams. The latter increases the contact pressure of contacts against the mating male tab terminal whilst nevertheless reducing the mating insertion forces thereof. The reversely bent-in and opposed contact arms provide for a compact design with a large number of contact points thereby enabling passage of high electrical currents.

10 Claims, 3 Drawing Sheets

HIGH CURRENT RECEPTACLE TERMINAL

BACKGROUND OF THE INVENTION

1. Field of the Invention

This invention relates to provision of a single body high current receptacle terminal.

2. Description of the Prior Art

For certain applications in the electrical industry, there is a continuing requirement to increase the electrical current carrying capabilities of contacts, while nevertheless providing a more compact and cost-effective contact design. Current carrying capability of an electrical terminal is largely determined by the number of contact points between mating contacts, and the contact pressure therebetween.

One common means of increasing the contact pressure is to provide a separate stainless steel back-up spring fitted to the inner contact body and assisting the contact tongues thereof at increasing the contact pressure. The addition of this outer back-up spring obviously increases the cost and the size of the terminal.

A further problem with many high current contacts is the high mating force when coupling to a corresponding tab terminal.

Yet a further problem with some multi-point contacts, is that the pressure of the various contact points, on a mating tab terminal, may be unevenly distributed due to the angular positioning of the tab contact, which decreases the current carrying capability therebetween.

It would therefore be desirable to provide an improved high current receptacle terminal that is compact, has reduced mating forces, and can carry high electrical currents reliably.

SUMMARY OF THE INVENTION

It is therefore an object of this invention to provide an electrical receptacle terminal with for high current applications, that is compact and reliable.

It is a further object of this invention to provide an electrical receptacle terminal for high current applications, which has reduced mating forces when coupled to a corresponding tab terminal.

It is a further object of this invention to provide a compact high current receptacle terminal having a large number of contact points, which is a unitary part stamped and formed from sheet metal and shaped in a manner to reduce usage of material.

The objects of this invention have been achieved by providing a receptacle terminal for high current applications, the terminal comprising a contact portion for receiving a male tab terminal therein, the contact portion comprising a base wall, side walls and top walls, the base wall comprising one or more contact protrusions projecting towards the top wall and the top wall having cantilever contact beams reversely bent into the contact section from opposing longitudinal ends of the contact section. Further improvements comprise provision of tabs struck from the side walls, upon which free ends of the cantilever beam contacts are supported for prestressing thereof. A further improvement is the slightly arcuate contact protrusions in the longitudinal direction, to allow rocking of the male tab terminal thereagainst for equalizing contact forces of the cantilever contact beams thereagainst. In a preferred embodiment, there are two pairs of contact beams extending from each opposed end of the top wall, each pair of contact beams comprised of individual cantilever contact beams joined together at their free ends.

DETAILED DESCRIPTION OF THE PREFERRED EMBODIMENT

Figure 1:
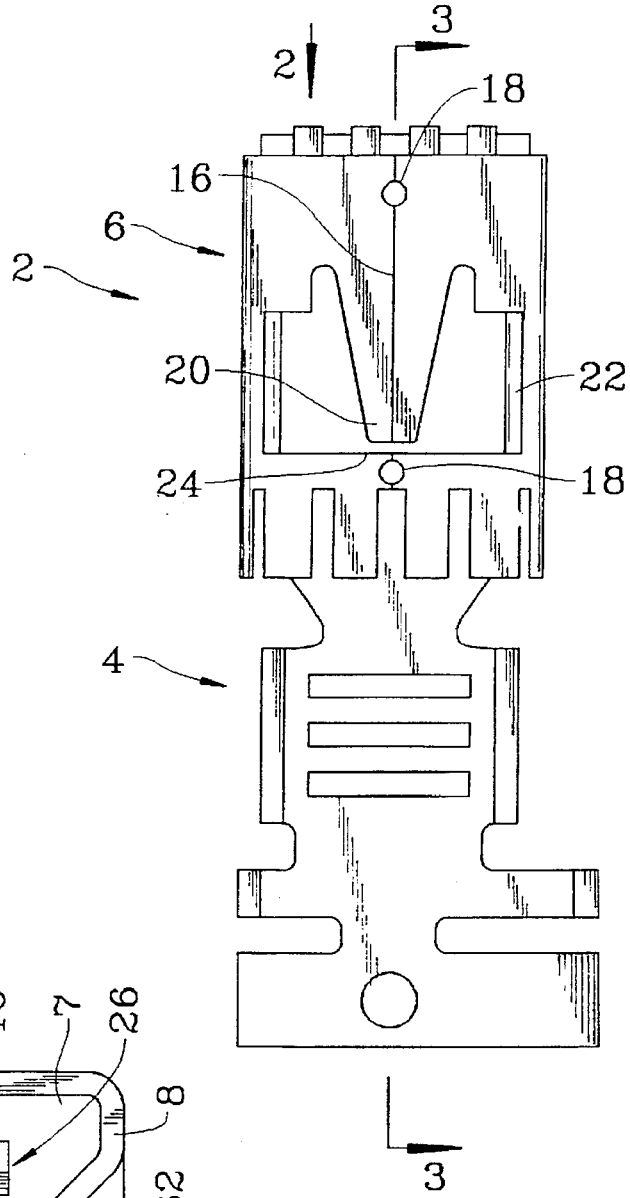
FIG. 1 is a top view of a receptacle terminal according to this invention.

Referring first to FIG. 1, a high current receptacle contact 2 is shown comprising a connection section 4 for crimping to an electrical conductor (not shown), and a contact section 6 for receiving a complementary tab terminal (not shown).

Figure 2:
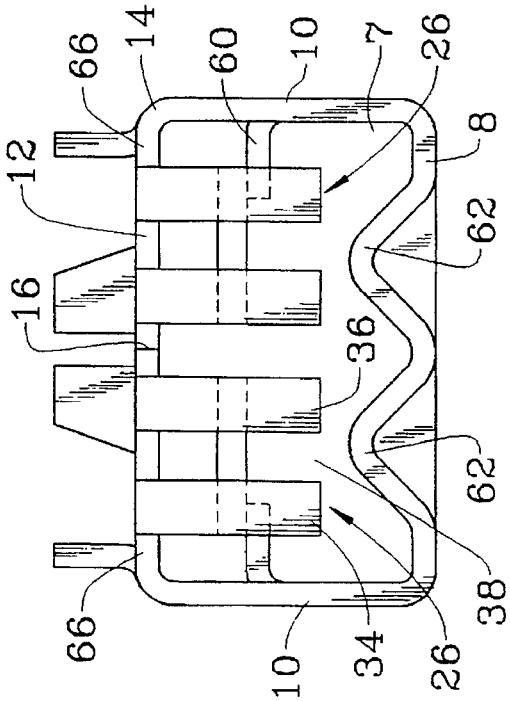
FIG. 2 is a view in the direction of arrow 2 of FIG. 1.

Referring now to FIGS. 1 and 2, the contact section 6 comprises a base wall 8, opposed side walls 10 extending perpendicularly from lateral edges of the base wall, and a split top wall 12 extending between top edges 14 of the side walls 10. A seam 16 extends longitudinally along the middle of the top wall 12 as a result of the folding together of the contact during the stamping and forming process, whereby the seam 16 is welded by laser produced welds 18 for rigidly holding together the contact section 6. Resilient locking lances 18 are stamped and formed out of the top wall 12, the locking lances projecting outwardly of the contact section 6 and serve to securely retain the receptacle terminal in a corresponding cavity of a connector housing. Further tabs 22 are stamped from the top wall 12 and extend outwardly substantially parallel to the side walls 10 from positions proximate to upper edges 14 thereof. The tabs 22 prevent wires and other objects from getting caught under the locking lances 20, because the tabs 22 project beyond the outermost ends 24 of the locking lances 20. Cables or other objects would therefore ride over or abut against the tabs 22 rather than slide between the locking lance and the top wall 12. The projections 22 can furthermore serve to preclude false orientation of the terminal 2 within a corresponding housing cavity by cooperation of the projections 22 in corresponding grooves of the housing.

Figure 3:
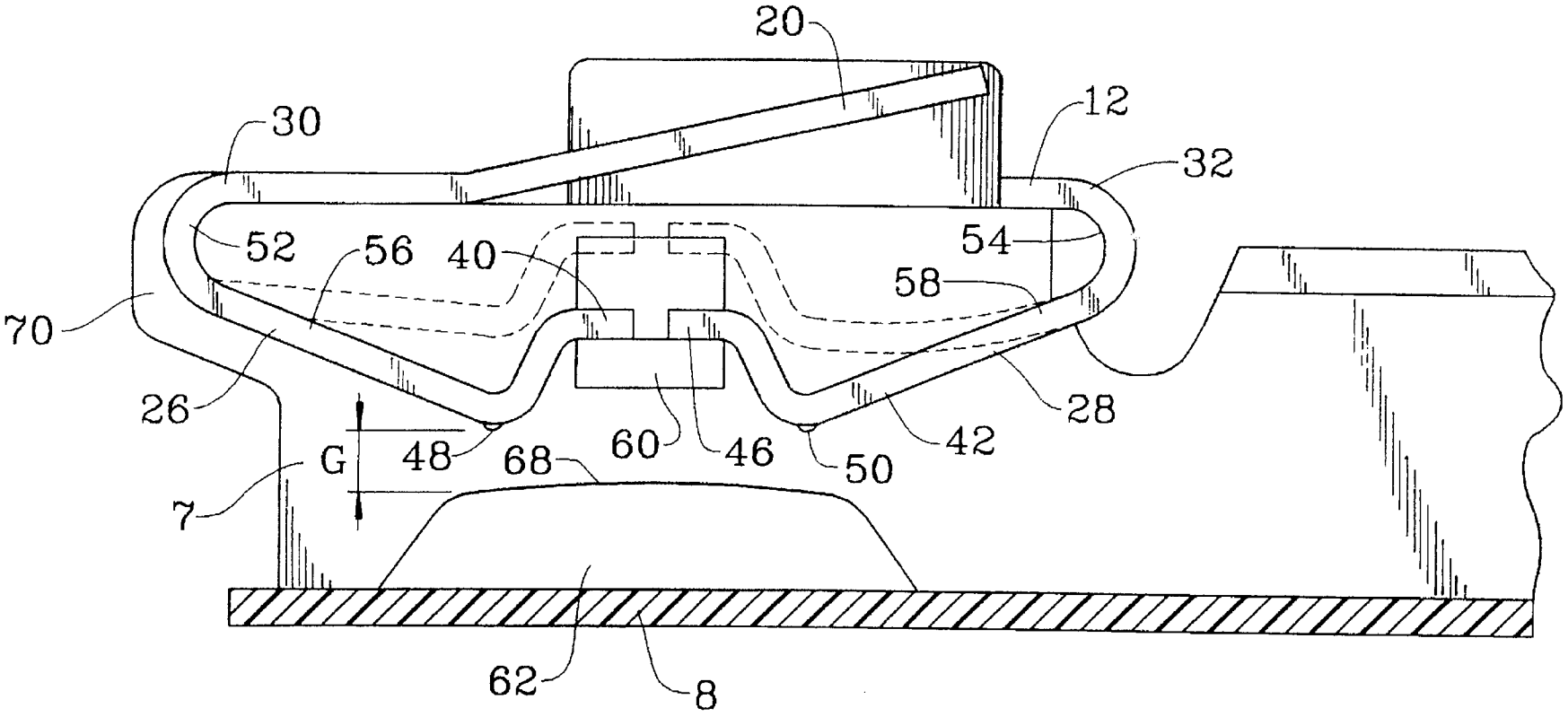
FIG. 3 is a cross-section through lines 3—3 of FIG. 1.
Figure 4:
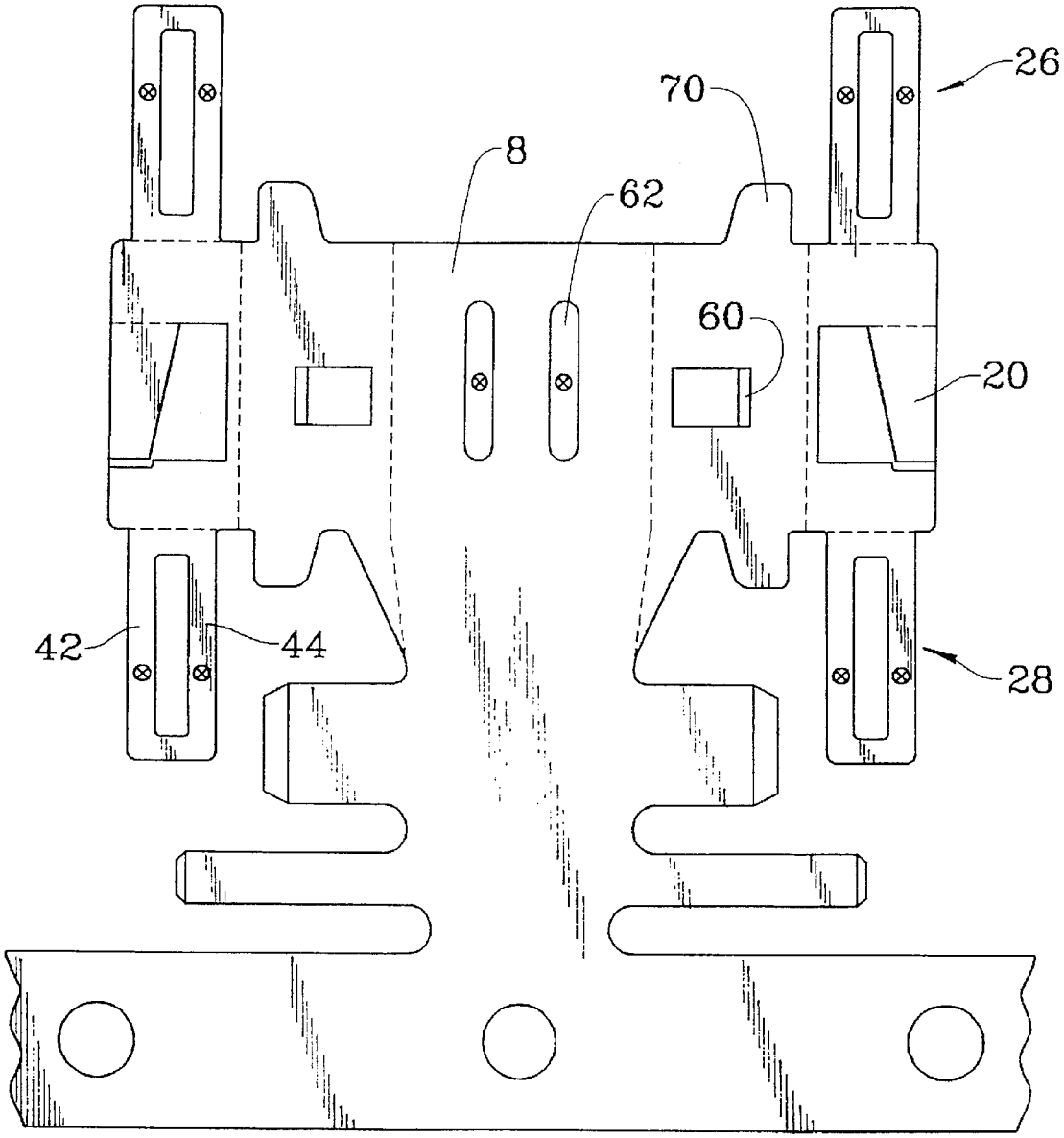
FIG. 4 is a plan view of a partially stamped and formed receptacle contact still attached to a carrier strip.

Referring now to FIGS. 3 and 4, the contact section has cantilever beam contact arms 26, 28 extending respectively from a tab receiving longitudinal end 30 and a connection side longitudinal end 32 of the top wall 12, whereby the cantilever beam contact arms are reversely bent into the tab receiving cavity 7. There are two pairs of contact arms 26 extending from the mating end 30 and two pairs of contact arms 28 extending from the connection end 32. Each pair of mating end contact arms 26, comprises two contact beams 34, 36 separated by a slot 38, the contact beams 34, 36 joined together at the to wall 12 and at their free ends 40. Similarly, the pairs of connection end contact arms 28 comprise individual contact arms 42, 44 joined together at the connection end 32 and at their free ends 46. Each individual contact arm 34, 36, 42 and 44 comprises a contact protrusion 48, 50 for making contact against a mating male tab terminal.

The contact arm pairs 26, 28 comprise respectively U-shaped attachment sections 52, 54 extending from ends 30, 32, the attachment section further extending into resilient beam sections 56, 58 that are directed towards the base wall 8 to a lower point where the contact protrusions 48, 50 are situated, the contact arms thereafter extending away from the base wall 8 to their free ends 40, 46. The attachment and resilient arm sections 52, 56 and 54, 58 of the contact arms 26, 28 respectively, form the spring portions of the contact arms to allow sufficient elastic bending thereof for producing the contact pressure.

Tabs 60 are struck inwardly from the side walls 10, the tabs providing ledges upon which the free ends 40, 46 of contact arms 26, 28 respectively can rest for prestressing the contact arms. Prestressing enables the contact pressure of the contact points 48, 50 against a mating tab to be increased whilst simultaneously reducing tab insertion forces due to the gap G formed between the contact points 48, 50 and contact protrusions 62 which protrude towards the contact arms from the base wall 8. If no gap G was provided, insertion forces would be higher as a large proportion of the insertion force is caused by the initial opening apart of resilient contacts. Providing a sufficiently large gap G will reduce insertion forces caused by this effect.

As the individual contact beams 34, 36 and 42, 44 of the contact arms 26, 28 respectively, are joined together at their free ends 40, 46, the ledge 60 can be made quite short. Furthermore, the contact arms 26, 28 are prevented from over-deformation by lateral portions 66 of the top wall 12 abutting the contact arm free ends 40, 46.

The contact protrusions 62 are formed from the base wall 8, and extend in the longitudinal direction whereby an upper contact surface 68 thereof is slightly arcuate in the longitudinal direction to allow angular movement of a male tab thereagainst in order to allow distribution of the spring forces of the mating and connection end contact arms 26, 28.

The side walls 10 comprise mating end extensions 70 that extend beyond the curved portion 52 of the contact arm 26 for protection thereof.

The terminal as described above is very compact yet can carry high currents because of the number of contact points (in this embodiment ten) and the generation of high contact forces due to prestressing of the contact arms, whereby use of the curved portion 52 and resilient arm 56 as spring members for the contact points makes optimal use of the spring. The reversely bent contact arms 26, 28 extending from opposing ends 30, 32 of the cover wall also provides for a compact design. A further important point is the relative independence of each of the contact points due to the large number of spring beams and the long slots therebetween, thereby ensuring that optimal contact pressure for each spring beam is achieved.

Furthermore, the slightly arcuate embossed base contact that extends longitudinally, allow angular adjustment of the tab for optimal distribution of the contact pressure of mating end and connection end contact points 48, 50. Prestressing of the reversely bent and opposed contact arms 26, 28 provides a compact design with high contact pressure, efficient use of the metal strip from which the contact is stamped an formed, and has reduced insertion force due to the prestressing and provision of the gap G between the contact points 48, 50 and the base contact protrusion 62.

Advantageously therefore, this receptacle contact for high current applications is compact, has reduced mating forces and a high number of contact points for increasing the current carrying capabilities thereof. Furthermore, efficient use is made of the sheet metal strip from which the receptacle contacts are stamped and formed.

We claim:

1. A receptacle terminal comprising a box-shaped contact portion for receiving a tab terminal therein, the contact portion extending longitudinally between a mating end and a connection end, and comprising a base wall, side walls and a top wall enclosing a tab receiving cavity, characterized in that the contact portion comprises a first mating end cantilever beam contact arm extending from the mating end to a free end, and a second connection end cantilever beam contact arm extending from the connection end to free end, the arms reversely bent into the tab receiving cavity and held in a prestressed position above one or more contact protrusions projecting from the base wall.

2. The terminal of claim 1 characterized in that the contact section comprises tabs against which the free ends rest for prestressing of the contact arms.

3. The terminal of claim 2 characterized in that the tabs are stamped out of the side walls.

4. The terminal of any preceding claim characterized in that one or more of the contact arms each comprise a pair of contact beams separated by a slot, each contact beam having a contact protrusion proximate the free end for contacting the mating tab contact.

5. The terminal of claim 4 characterized in that the contact beams of one or more contact arms are joined together at their free end.

6. The terminal of claim 5 characterized in that the slot extends substantially from the top wall to the free end for substantially decoupling the contact protrusions of the contact beams of the corresponding contact arm, such that optimum contact pressure of each contact protrusion against a mating tab contact is provided.

7. The terminal of claim 1 characterized in that one or more contact protrusions projecting from the base wall extend longitudinally and have a slightly acute longitudinal contact surface for allowing angular longitudinal adjustment of the mating tab contact, thereby enabling optimal distribution of resilient contact forces between the mating end and connection end contact arms respectively against mating tab contact.

8. The terminal of claim 1 characterized in that the side walls comprise protective extensions projecting beyond a furthermost mating end portion of the mating end contact arms for protection thereof.

9. The terminal of claim 1 characterized in that the contact portion comprises tabs stamped and bent out of top wall and flanking a resilient locking lance, the tabs projecting beyond the locking lance for preventing foreign objects from entanglement therewith.

10. The terminal of claim 1 characterized in that multiple first mating end cantilever contact arms and second connection end cantilever beam contact arms are included.

* * * * *